United States Patent [19]

Kirilloff et al.

[11] Patent Number: 4,847,585

[45] Date of Patent: Jul. 11, 1989

[54] CENTER VENTILATED RESISTOR GRID

[75] Inventors: Victor V. Kirilloff, Lincoln, Nebr.; William A. Benson, Pittsburgh; Robert Cummins, Pittsburgh; Richard S. Dawson, Pittsburgh, all of Pa.

[73] Assignee: Mosebach Manufacturing Company, Pittsburgh, Pa.

[21] Appl. No.: 196,250

[22] Filed: May 20, 1988

[51] Int. Cl.[4] ..... H01C 1/08

[52] U.S. Cl. ..... 338/58; 338/279; 338/290; 338/295

[58] Field of Search ..... 338/58, 279, 280, 290, 338/295; 219/532, 531, 537, 539

[56] References Cited

U.S. PATENT DOCUMENTS

| | | | |
|---|---|---|---|
| 2,858,402 | 10/1958 | Griffes et al. | 338/58 |
| 3,858,149 | 12/1974 | Kirilloff | 338/58 X |
| 4,011,395 | 3/1977 | Beck | 338/279 X |
| 4,100,526 | 7/1978 | Kirilloff et al. | 338/279 |
| 4,146,868 | 3/1979 | Kirilloff et al. | 338/58 X |
| 4,316,172 | 2/1982 | Luy | 338/280 |
| 4,651,124 | 3/1987 | Kirilloff et al. | 338/280 |
| 4,651,125 | 3/1987 | Harkness | 338/295 |

*Primary Examiner*—E. A. Goldberg
*Assistant Examiner*—M. M. Lateef
*Attorney, Agent, or Firm*—Buchanan Ingersoll; Paul A. Beck; Gordon R. Harris

[57] ABSTRACT

A resistor grid for diesel electric locomotives and the like has a rigid frame comprising outer metal side pieces and one or more pairs of inner metal side pieces spaced from each other, and columns of resistor ribbon fan-folded between each outer and outermost inner side piece, and between certain inner side pieces. Supporting means interengaging each fold of the ribbons are insulated from and carried on each side by a metal strip which rides on its adjoining side piece so as to accommodate expansion of the resistor ribbon. The ribbon is indented between folds to stiffen it and increase its span and may by provided with a support rod centered between its side pieces. The resistor grid is preferably positioned in forced air cooled resistor banks face-to-face with conventional narrow span grids, and improves the cooling of such conventional banks.

10 Claims, 5 Drawing Sheets

CENTER VENTILATED RESISTOR GRID

BACKGROUND OF THE INVENTION

Frame-supported resistor grids of the type generally used prior to our invention disclosed hereinafter are shown in Kirilloff U.S. Pat. Nos. 4,100,526 and 4,651,124. The resistor strip or ribbon is fan-folded back and forth and held in place between side members by studs affixed to certain of the folds or loops, which studs are received by holes in the side members, if they are of insulating material, or, where the side members are metal, by bushings of insulating material fixed in those members.

The space allotted to dynamic braking resistors in diesel-electric locomotives is limited. The resistor units are mounted vertically in banks, face to face, adjacent ventilating fans which draw air through the bank. A loop of sagging ribbon may make contact with an adjoining loop, thus shorting part of the resistor strip. Prior to our invention to be described hereinafter, the length of ribbon between its folds or loops had to be limited to avoid sagging, and the fan-folded ribbon was therefore arranged in a number of rows or columns, in the same plane, with separator plates therebetween carrying bushings of insulating material. One attempted solution to this problem is disclosed in Harkness U.S. Pat. No. 4,651,125, issued Mar. 17, 1987. His resistor is not fan-folded strip but comprises a series of grid members preformed from metal strip with cylindrical legs at each end which fit into holes on insulating side panels. The grid members are doubled back on each other and welded or otherwise joined to provide a serpentine path from one end to the other. The members are stiffened by longitudinal ribs and can be made long enough that only two columns of grid members fill a frame.

When several resistors are assembled in banks, the cooling effect of the induced air is greater for the portions of the ribbon between loops than for the looped ends. Resistor grids commercially available prior to our invention comprised as many as eight columns or rows of fan-folded or otherwise reflexed resistor ribbon, as illustrated in the Kirilloff patents above mentioned.

SUMMARY OF THE INVENTION

We have found that resistor grids of improved durability can be formed within a rigid frame from as few as two columns or rows of fan-folded continuous resistor ribbon, the columns occupying essentially the entire width of the grid, the ribbon being embossed in longitudinally extending indentations between folded ends and the frame comprising inside and outside metal side pieces for each column, the inner side pieces being spaced apart so as to facilitate the pulling of cooling air through the grids from front to back and between inside and outside loops of the ribbon. We have also found that when resistor grids of our invention to be described hereinafter are arranged in banks with conventional fan-folded resistor grids of the patents above mentioned so that the spaces between the inside side pieces of the columns of our resistor grids are aligned with the looped ends of the conventional grids, more uniform cooling of the entire bank was obtained. Resistor grids of our invention may have adjoining ribbon columns of different spans, as will be described, and different arrangements of columns of different spans, as will also be described. We have also invented an auxiliary center support for each row or column where stiffening indentations of the ribbon are impractical or insufficient for their purpose. We have also invented a resistor grid as herein described comprising two or more rows or columns of narrow fan-folded resistor ribbon positioned edge-to-edge between inside or inside and outside side pieces of the frame.

DESCRIPTION OF THE PREFERRED INVENTION

Figure 1:
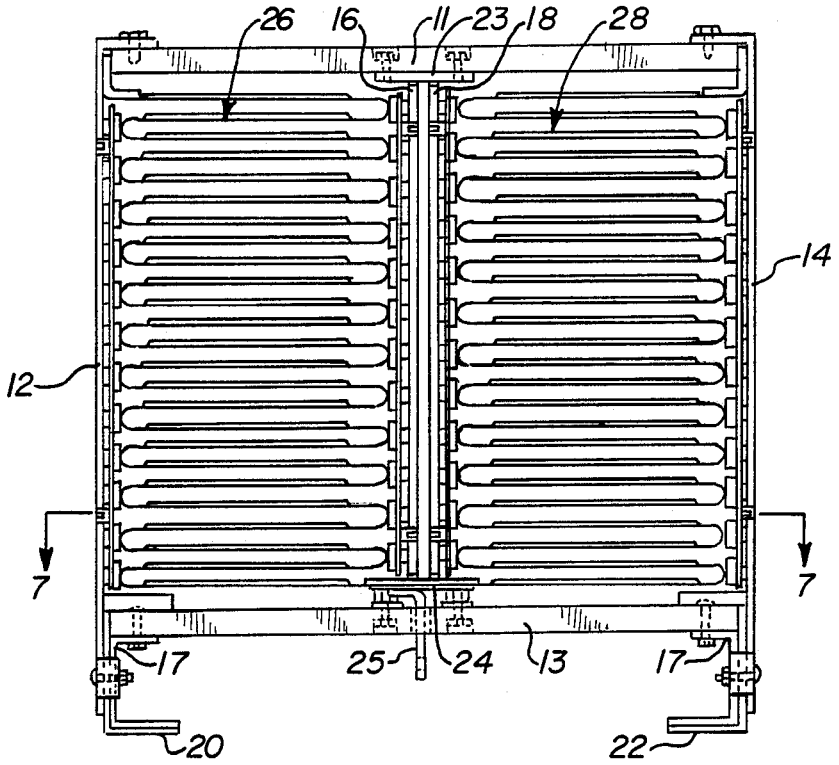
FIG. 1 is an illustration of a resistor grid of our invention comprising two columns of the same span of fan-folded resistor ribbon.

Our resistor unit as shown in FIG. 1 is mounted in a rectangular frame of top and bottom end members 11 and 13, respectively, made of insulatng material, outer side members 12 and 14, respectively, and inner side members 16 and 18, respectively. Members 12 and 14, 16 and 18 are metal, preferably steel, either flats or channels. Top end member 11 is fastened at each end to turned-over ends of outer side members 12 and 14 and bottom end member 13 is bolted at each end to those side members. The bottom and top members are preferably non-conductive high-temperature resistant materials. The lower ends 20 and 22 of each outer side member 12 and 14, respectively, are each bent around inwardly against the lower leg of its respective U-shaped member 17 to make mounting feet for the unit, which feet are also resistor terminals as will appear. The inner side members 16 and 18 are spaced from each other and are fixed, preferably by welding, to a plate 23 at their upper ends and a similar plate 24 at their lower ends, those plates in turn being affixed to top end member 11 and bottom end member 13 by appropriate fasteners. A terminal 25 is affixed to plate 24 normal thereto and extends through a hole in bottom end member 13.

Figure 7:
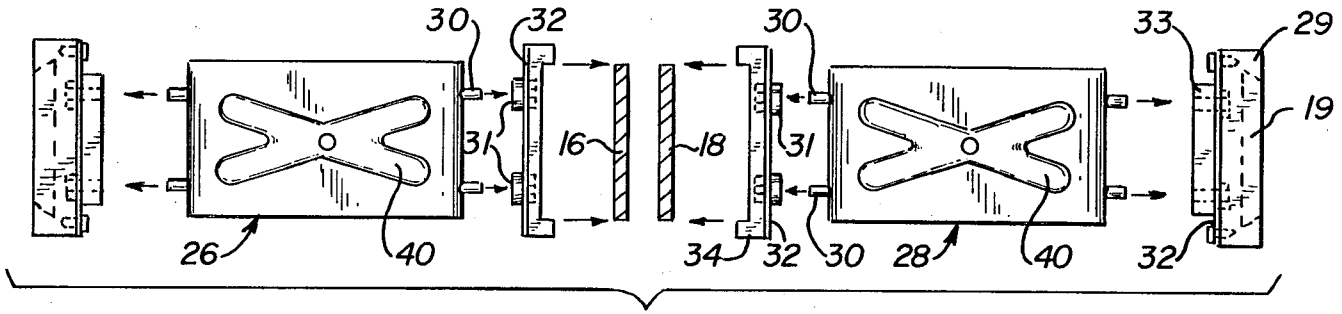
FIG. 7 is an exploded horizontal section of the grid of FIG. 1 taken generally on the plane 7—7 thereof.

A continuous ribbon 26 of resistance material is fan-folded back and forth between side members 12 and 15 from top end member 11 to bottom end member 13 and a like ribbon 28 is fan-folded in the same way between side members 14 and 18 from top end member 11 to bottom end member 13. To each loop end or fold of each ribbon 26 and 28 is affixed a pair of metal studs 30 side-by-side, preferably by welding, as is shown in FIG. 7. In one embodiment of our invention, the studs 30 fit into ceramic bushings 31 which are set in metal plates 32, one such plate 32 corresponding to each side member. The plates 32 are held in place against their respective side members by channel clips 34 which are dimensioned to fit over the side members by friction, but are not otherwise attached thereto. End plate 32 is preferably attached to its side member by channel clips 34 and can move longitudinally along with its bushings 31 with respect to its side member to accommodate expansion or other movement of ribbons 26 or 28. For that purpose, the length of each mounting plate 32 is somewhat less than the inside space along its side member. A stop pad 36 is affixed at each end of bottom member 13 on its upper side, the pad having a thickness which properly positions plate 32 with respect to its side member.

In another embodiment of our invention also shown in Figure 7, the side members 19 are dovetailed in section and the channel clips 29, which may be made of insulating material such as organic copolymer having a high tolerance of high temperature fit over the side members. Instead of individual insulating bushings 31, rectangular ceramic bushings 33 accommodating two studs may be set in plates 32. Alternatively, individual square bushings may be used.

The upper ends of resistor strips 26 and 28 are electrically connected to the upper ends of side plates 12 and 14, respectively. The lower ends of those resistor strips are electrically connected to plate 24 carrying terminal 25.

Figure 2:
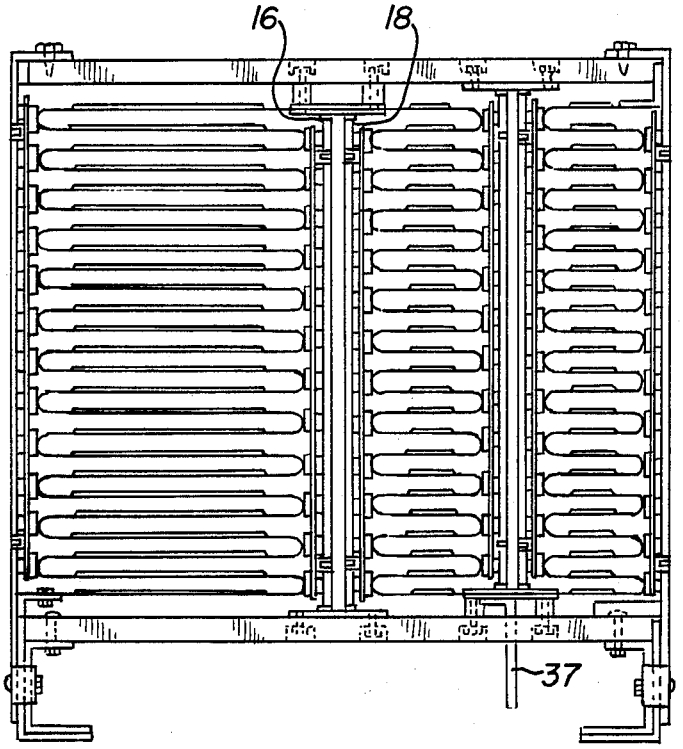
FIG. 2 illustrates a resistor grid of our invention comprising three columns of fan-folded resistor ribbon; the left-hand column occupying substantially the same space as the two right-hand resistor columns.
Figure 3:
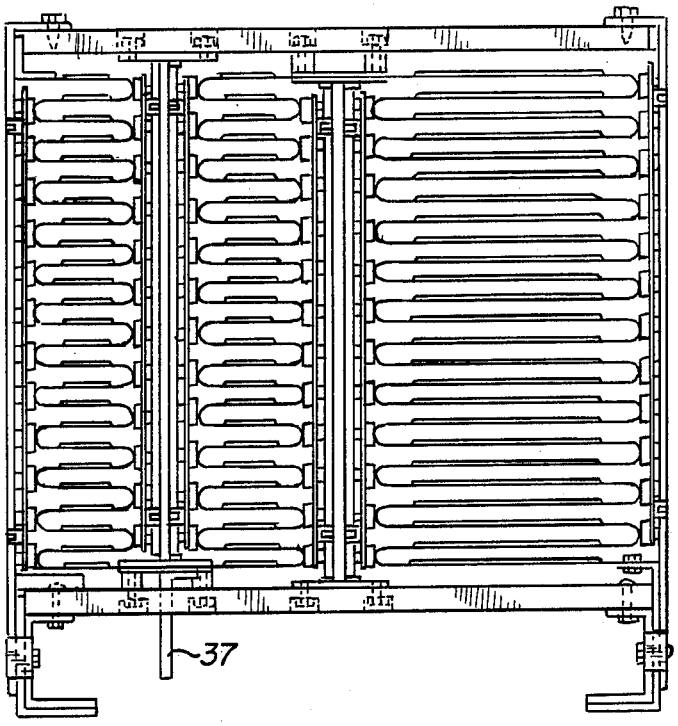
FIG. 3 is a mirror image of the article of FIG. 2.
Figure 4:
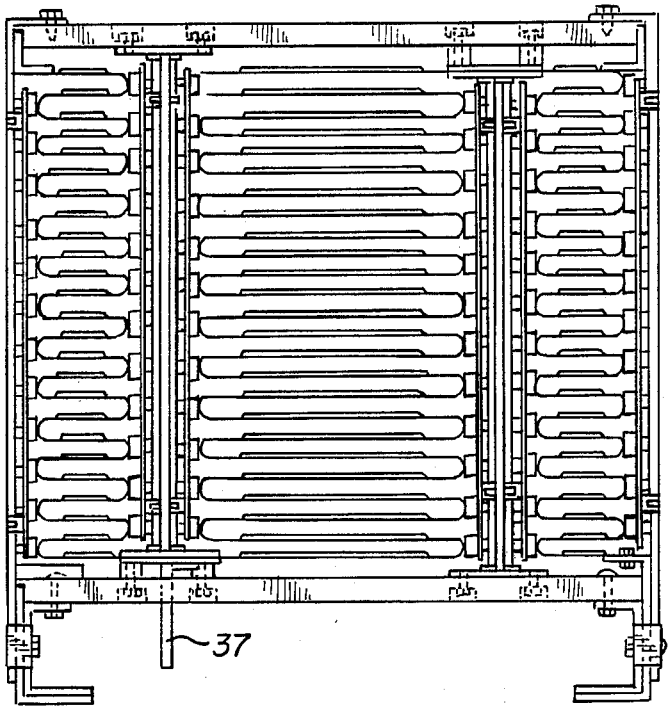
FIG. 4 illustrates a resistor grid of our invention comprising three columns of fan-folded resistor ribbon, the center column occupying a space substantially equal to the sum of the spaces occupied by the two outside columns.
Figure 5:
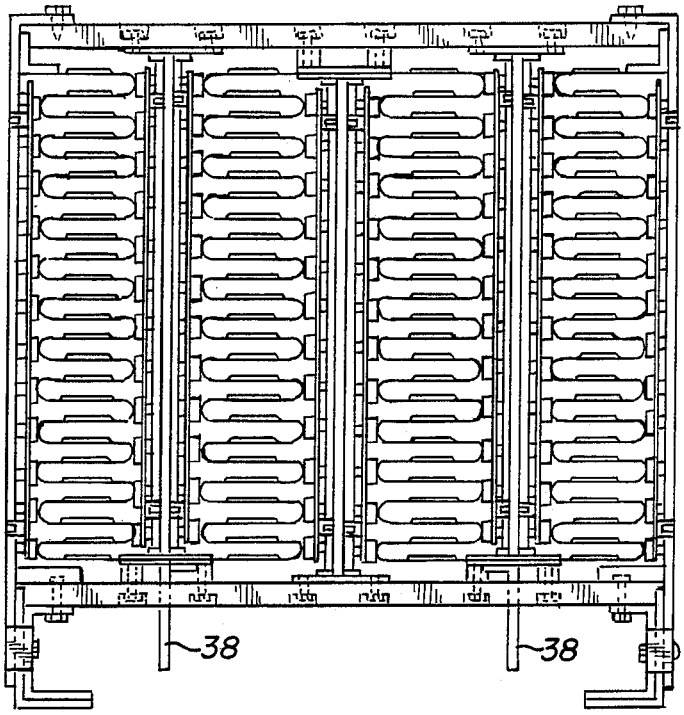
FIG. 5 is an illustration of a resistor grid of our invention comprising four columns of substantially equal width of fan-folded resistor ribbon.

Other forms of our resistor grid are shown in FIGS. 2 through 4 utilizing resistor ribbon spans of one-half the width of the grid and spans one-fourth the width of the grid and, in FIG. 5, of a grid using four columns of ribbon each having a span of one-fourth of the width of the grid. The structure of these embodiments is the same as that of our FIG. 1 which has been described hereinabove, except for the tap. In FIGS. 2, 3 and 4, the tap 37 is at one-quarter of the full resistance value. In FIG. 5 the taps 38 are at one-quarter and three-quarters of the total value of the resistance.

Figure 12:
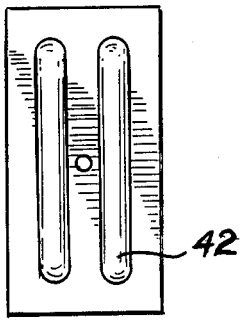
FIG. 12 is a detail of another alternative form of stiffening embossment of our resistor ribbon.

Each resistor strip 26 and 28 is embossed or otherwise provided with an indentation 40 in the form of an X, illustrated in FIG. 7, at intervals corresponding to the horizontal runs of the resistor strip and are so indented before the strip is folded. FIGS. 4 and 12 illustrate other forms of indentations 41 and 42 suitable for the purpose of stiffening the strip so as to resist sagging when the strip is heated.

Figure 8:
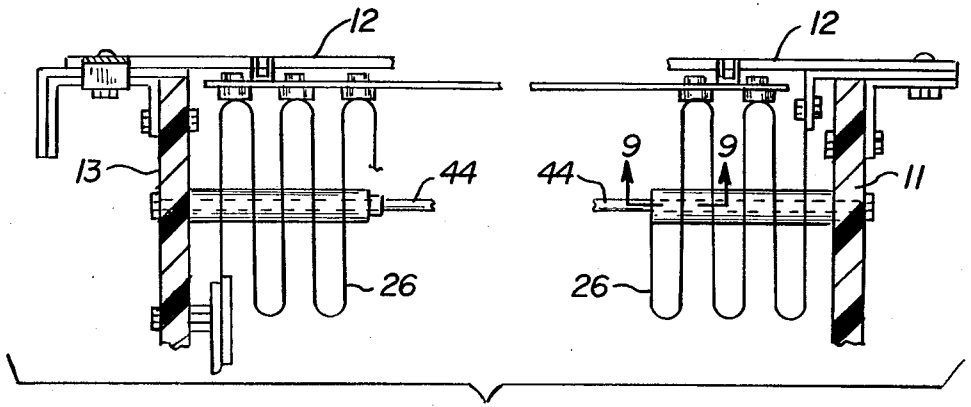
FIG. 8 is a partial elevation of an embodiment of our invention utilizing a center support rod for the fan-folded resistor ribbon.
Figure 9:
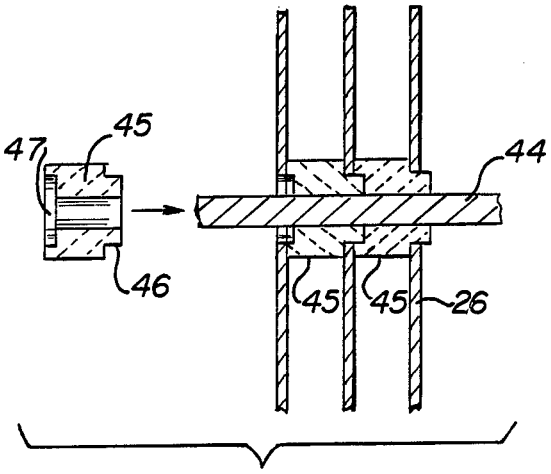
FIG. 9 is a section of the center support of FIG. 8 taken on the plane 9—9 thereof.

Under severe conditions, additional support for the resistor strip may be necessary to prevent short circuits. FIGS. 8 and 9 illustrate an auxiliary support. A support rod 44 is positioned intermediate the folded ends of each resistor ribbon 26 and 28 so as to pass through holes in the horizontal runs and is attached at its upper end to top end member 11 and at its lower end to bottom end member 13. Rod 44 may be metal or high-temperature resistant plastic or fiber. Rod 44, if necessary, is insulated from the resistor strip by interlocking insulator bushings 45 which fit over the rod, as shown in FIG. 4. Those bushings are cylindrical with a recess 47 at one end and a reduced diameter 46 in the other end.

Figure 6:
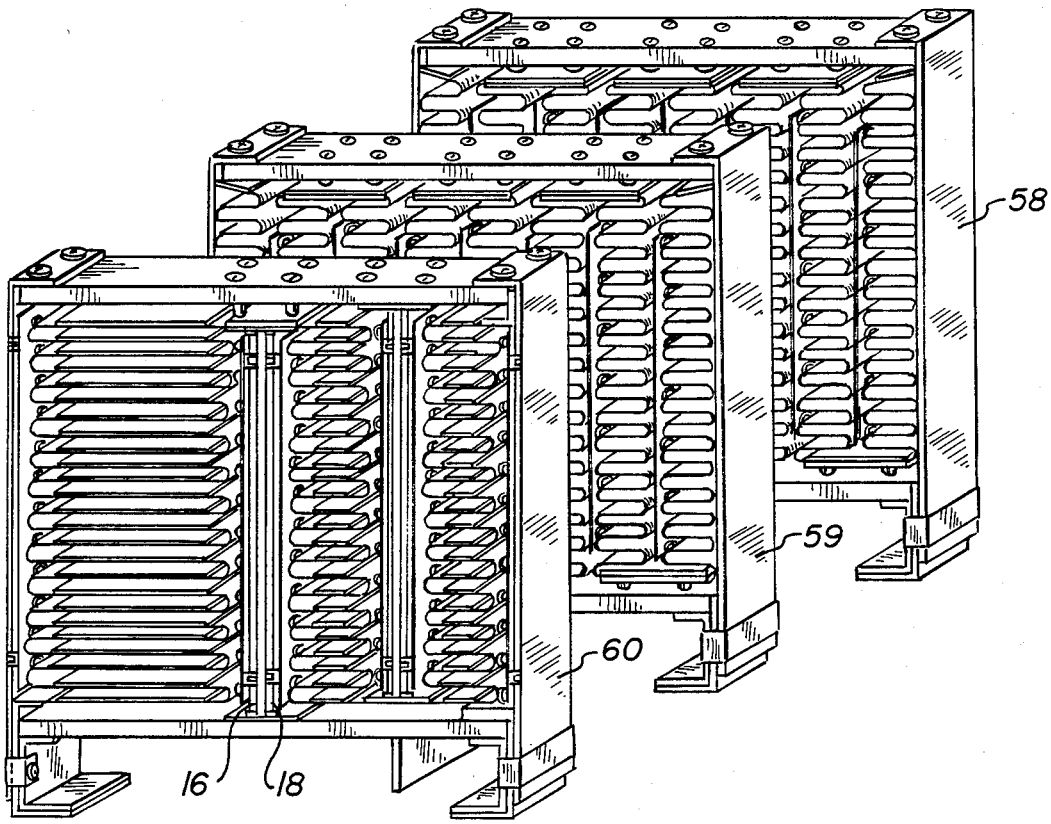
FIG. 6 illustrates diagrammatically a bank of three resistor grids, the foremost grid being that of our FIG. 2 herein nad the rear grids being conventional grids as disclosed in the Kirilloff patents previously mentioned.

In the resistor bank illustrated diagrammatically in FIG. 6, three grids 58, 59 and 60 are shown, one behind the other. Grids 58 and 59 are of the form disclosed in the Kirilloff patents, each having eight columns of resistor ribbon. Grid 60 is that of FIG. 2 though it could be that of FIGS. 1, 3, 4 or 5 of this application. The open space between inside members 16 and 18 of units 59 and 60 is aligned with the loop ends of the fourth and fifth columns of the conventional units 58 and 59. The structure of unit 60, an article of this invention, channels more of the cooling air drawn through the units 58, 59 and 60 to those loop ends in units 58 and 59 than would otherwise be directed there if grid 60 were replaced by a duplicate of grids 58 and 59 because in those units the separator plates and stud receptacles impede airflow in those areas.

Figure 10:
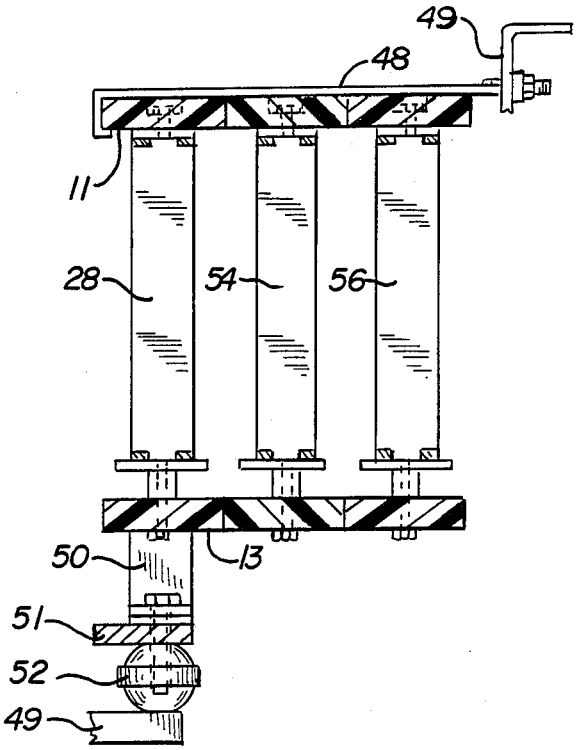
FIG. 10 is a partial section of an embodiment of our invention comprising three narrow resistor ribbons mounted edge to edge.
Figure 11:
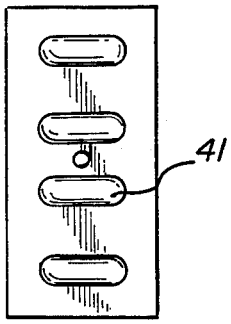
FIG. 11 is a detail of an alternate form of stiffening embossment of our resistor ribbon.

While we have described units having two or more prefabricated resistor strips mounted end-to-end within the frame, our invention here described may be incorporated in a structure having four or even six resistor strips, the additional strips 54 and 56 being mounted edge-to-edge with strips 26 and 28 of the two resistor strips first mentioned, as shown in FIG. 10. It is preferable to have each two-strip unit insulated from the other which is accomplished by making the top and bottom frame ends of insulating material wider than its side members, both inner and outer. FIG. 10 also illustrates how a clamp 48 is used to clamp at their upper ends the three units there shown to the frame 49 of the locomotive and a supporting member 50 to clamp the unit at its lower ends to locomotive busbar 51 and, through a standoff insulator 52, also the locomotive frame.

Our resistor grid described hereinabove is less expensive to manufacture than conventional units with multiple rows or columns of narrow-span fan-folded resistor ribbon and is considerably more rugged. It is superior to the Harkness unit when mounted in banks because of the spacing between its inner side pieces. That spacing permits cooling air to be easily drawn through our unit and impinge upon units behind it whereas the Harness unit has a double width insulating member which impedes the flow of cooling air in that region.

The center bracing by the inner side members permits the use of high temperature resistant organic insulating material for the top and bottom end members.

We claim:

1. In a rectangular resistor grid unit having insulating top and bottom end members and electrically conductive outer side members connected with said top-and-bottom end members, the improvement comprising at least one pair of electrically conductive inner side members mechanically connected to said top and bottom end members and spaced from each other, a fan-folded resistor ribbon disposed between each outer side member and its respective inner side member, the upper ends of said ribbons being electrically connected to the upper ends of said outer side members and the lower ends of said ribbon being connected to at least one terminal extending below said bottom end member, separate mounting plates each supported by one of said side members, insulated mounting means carried by each said plate, and means interfitting with said mounting means engaging each fold of each said ribbon.

2. The resistor grid of claim 1 in which said pair of inner side members is positioned approximately midway between said outer side members.

3. The resistor grid of claim 1 having two pairs of inner side members, a first pair being positioned approximately midway between said outer side members, a second pair being positioned approximately midway between said first pair and an outer side member and fan-folded resistor ribbon columns disposed between said innermost inner side members in series with said fan-folded resistor ribbon columns disposed between each outer side member and its respective inside member.

4. The resistor grid of claim 1 having three pairs of inner side members spaced evenly between said outer side members and four fan-folded resistor ribbon columns serially connected disposed respectively between said outer side members and said three pairs of inner side members.

5. The resistor grid of claim 1 in which the resistor ribbon is embossed so as to stiffen it longitudinally.

6. The resistor grid of claim 1 in which said bushing mounting plates are carried by said side members so as to permit movement of said plates with respect to said side members longitudinally thereof.

7. The resistor grid of claim 4 including a stop pad affixed to said bottom end member so as to limit the downward movement of said bushing mounting plate.

8. The resistor grid of claim 1 including a support rod positioned intermediate said folded ends of said ribbon, extending through said ribbon and fixed at its ends to said top and bottom end members and spacing elements on said rod between the flights of said ribbon.

9. The resistor grid of claim 1 in which the top-and-bottom end members are high temperature-resistant insulators.

10. The resistor grid of claim 1 including at least two separate electrically conductive outer side members on each side, at least two pairs of said electrically conductive inner side members, and at least four said fan-folded metallic ribbons separately disposed between each said outer side member and its said respective inner side member, said ribbons on each side being disposed edge-to-edge.

* * * * *